United States Patent [19]

Axelsson

[11] 4,362,472

[45] Dec. 7, 1982

[54] ROTARY COMPRESSOR WITH VARIABLE BUILT-IN VOLUME RATIO

[75] Inventor: Rolf I. Axelsson, Norrkoping, Sweden

[73] Assignee: Stal Refrigeration AB, Norrkoping, Sweden

[21] Appl. No.: 158,061

[22] Filed: Jun. 9, 1980

[30] Foreign Application Priority Data

Jun. 8, 1979 [SE] Sweden ..... 7905002

[51] Int. Cl.[3] ..... F04B 49/00

[52] U.S. Cl. ..... 417/53; 417/280; 418/201

[58] Field of Search ..... 417/53, 279, 280, 290, 417/315; 418/201, 202

[56] References Cited

U.S. PATENT DOCUMENTS

| | | | |
|---|---|---|---|
| 1,231,613 | 7/1917 | James | 417/279 |
| 2,625,660 | 1/1953 | Lytle | 417/279 X |
| 3,936,239 | 2/1976 | Shaw | 417/315 |
| 4,080,110 | 3/1978 | Szymaszek | 417/280 |

*Primary Examiner*—Carlton R. Croyle
*Assistant Examiner*—Edward Look
*Attorney, Agent, or Firm*—Cyrus S. Hapgood

[57] ABSTRACT

A rotary compressor has an outlet port with a variable area for discharging compressed medium from a working chamber to the outlet. The degree of opening of the outlet port is controlled by a regulator which senses the energy supplied to the compressor for compressing the medium and which from time to time changes the degree of opening of the outlet port until the need of drive energy for the compressor becomes minimal.

7 Claims, 9 Drawing Figures

ROTARY COMPRESSOR WITH VARIABLE BUILT-IN VOLUME RATIO

Figure 1:
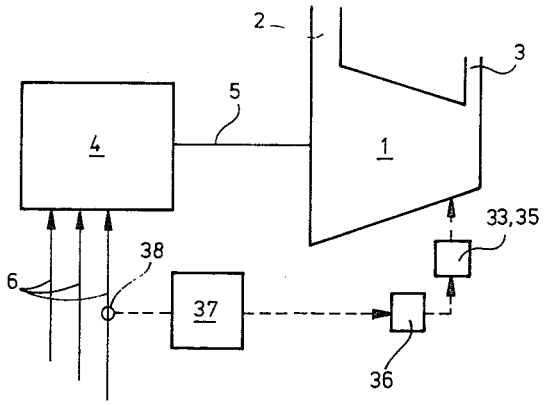

The present invention relates to a method of driving a compressor of the rotary type and an apparatus for carrying out the method. The compressor is of the kind where a medium is compressed in working chambers formed between at least one rotor and a wall which surrounds the rotor. The working chambers on rotation of the rotor suck in the medium from an inlet, after which each working chamber is closed towards the inlet and decreases its volume so that the medium is compressed, and the working chamber thereafter is brought into communication with an outlet by an edge of the rotor together with an edge of an outlet port uncovering a passage from the working chamber to the outlet, which edge of the outlet port is adjustable so that by displacing the edge of the outlet port the pressure in the working chamber, when it begins to open towards the outlet, becomes adapted to the pressure in the outlet.

A compressor of this kind is disclosed, for example, in U.S. Pat. No. 3,936,239, which discloses a compressor where the built-in volume ratio can be varied by displacement of an edge of an outlet port which brings a working chamber into communication with an outlet from the compressor. By built-in volume ratio is meant the ratio between the volume which a working chamber of the compressor takes when its communication with the inlet of the compressor is broken, and the volume which a working chamber of the compressor takes when the working chamber is brought into communication with the outlet from the compressor. The object of varying the built-in volume ratio by displacing the said edge of the outlet port is to cause the pressure in the working chamber, when it begins to open towards the outlet, to equal the pressure in the outlet, whereby the mechanical energy which is required to compress the medium to the pressure which prevails in the outlet becomes minimal.

In a compressor where said edge of the outlet port is not displaceable, the pressure in the working chamber, when it begins to open towards the outlet, will only rarely be equal to the pressure in the outlet. Usually the medium will instead be over-compressed or under-compressed when the working chamber begins to open towards the outlet, which is due to the fact that the pressures in the inlet and in the outlet of the compressor vary, which in turn is due to varying operational conditions in the system to which the compressor is connected. Said over-compression and under-compression mean loss of mechanical energy.

In the known compressor, where the displaceable edge of the outlet port constitutes an edge of an element movable in the longitudinal direction of the compressor, the adjustment of the edge is brought about by the pressure in the working chamber, when it begins to open towards the outlet, and the pressure in the outlet being sensed, the difference of said pressures being used to displace the element with the edge until the pressure difference becomes equal to zero.

It is relatively complicated, however, to arrange a sensing means which senses the pressure in the working chamber when it begins to open towards the outlet. Furthermore, it is relatively complicated to transmit the pressure which the sensing means senses to a place outside the working chamber, where said pressure can be compared with the pressure in the outlet. Also, it is not known with certainty whether the pressure which the sensing means senses is really the pressure which prevails in the working chamber when it opens towards the outlet. The element with the edge will adjust itself so that the pressure which the sensing means senses and the pressure in the outlet become equal. If the pressure which the sensing means senses differs from the pressure which really prevails in the working chamber, when it opens towards the outlet, a loss of mechanical compression work will result.

The principal object of the present invention is to overcome the above-noted drawbacks of the known compressor.

These drawbacks are overcome by the method of the invention comprising the steps of sensing an operational quantity which is a measure of the energy supplied to the rotor for obtaining compression of the medium and transferring of the medium to the outlet, and from time to time displacing the edge of the outlet port until said operational quantity acquires a value corresponding to a minimum of said energy.

In an apparatus according to the invention, said drawbacks are overcome through a means for sensing an operational quantity which is a measure of the energy supplied to the rotor for obtaining compression of the medium and transferring of the medium to the outlet, the sensing means being connected to a regulator arranged to start an adjusting motor from time to time for displacing the edge of the outlet port until said operational quantity has a value corresponding to a minimum of said energy.

What is desired primarily in the previously known compressor is to reduce to a minimum the energy required to compress the medium. The arrangement in this prior compressor is based on the knowledge that said minimum occurs when the medium is neither over-compressed nor under-compressed, which can be difficult to attain in a compressor of the known kind, as previously mentioned.

According to the present invention, one does not bother to go the roundabout way via the pressures in question in the compressor to adjust the edge of the outlet port so that one obtains an energy need for driving the compressor which should be minimal, but one instead adjusts the edge of the outlet port so that said energy need, which one senses on the device for driving the compressor, really becomes minimal. The arrangement according to the present invention is furthermore very simple structurally.

According to one embodiment of the invention, the regulator is arranged to start the adjusting motor with equal time intervals. This is a simple means to insure that the edge of the outlet port is correctly set. When the compressor is connected to a system where the pressures seldom are changed, the intervals can be made longer. If said pressures are often changed, the intervals are preferably made shorter.

According to another embodiment of the invention, which is intended to be used when the rotor is driven by an electric motor at constant voltage and constant number of revolutions per minute, the sensing means is arranged to sense the amperage supplied to the electric motor, which amperage constitutes said operational quantity. This provides a very simple way to sense the energy which is required to drive the compressor when it is driven by an electric motor.

Figure 2:
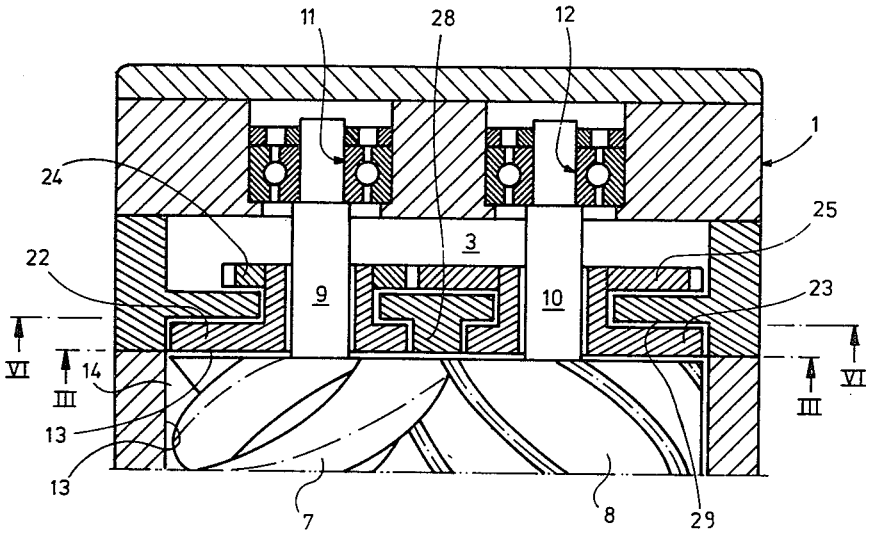
Figure 3:
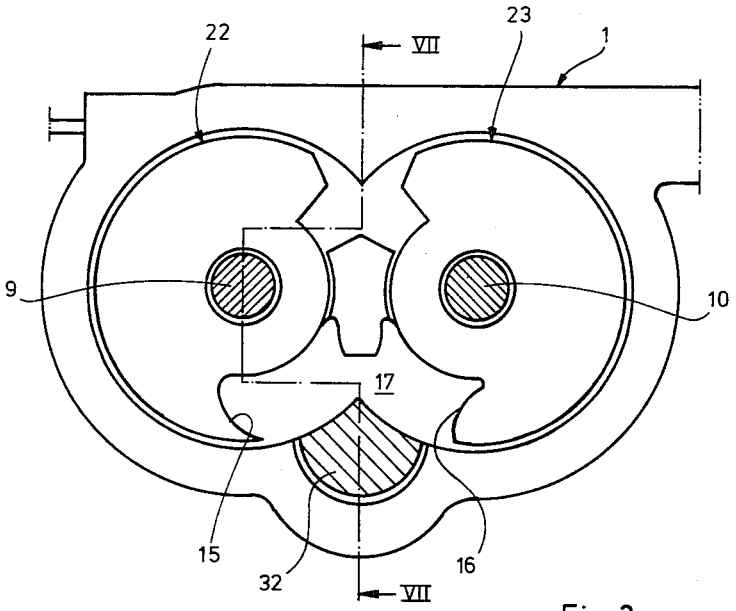
Figure 4:
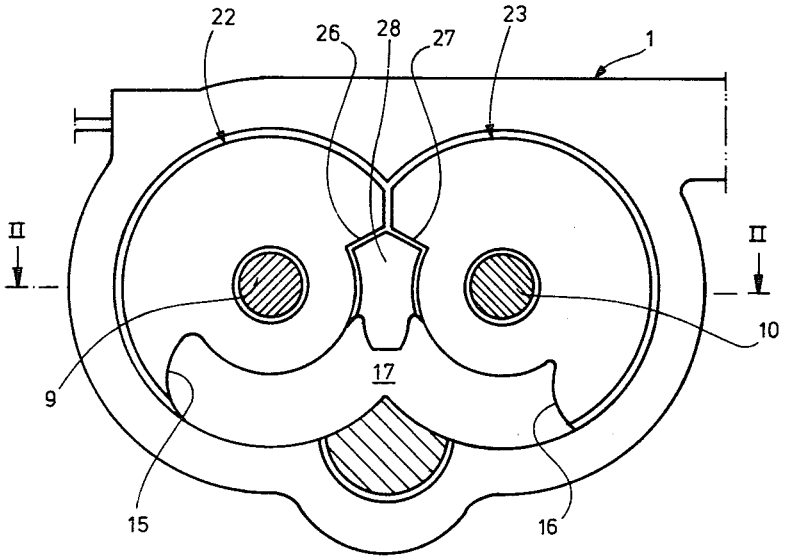
Figure 5:
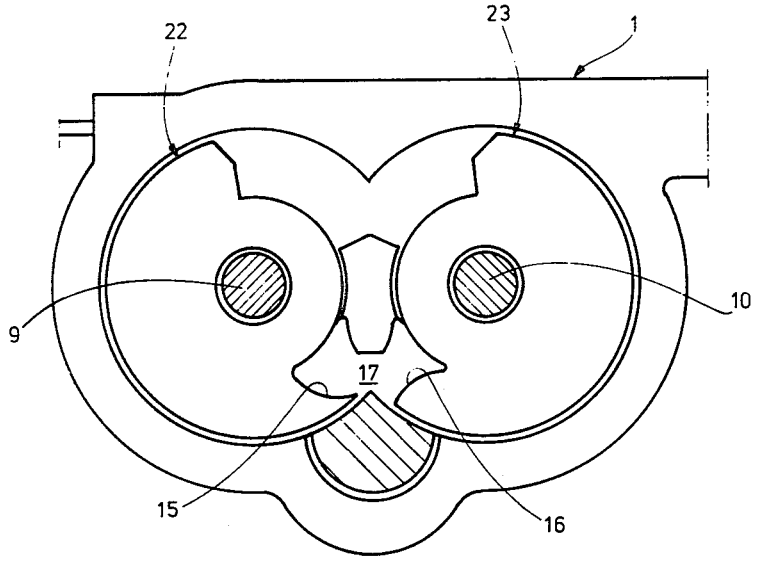
Figure 6:
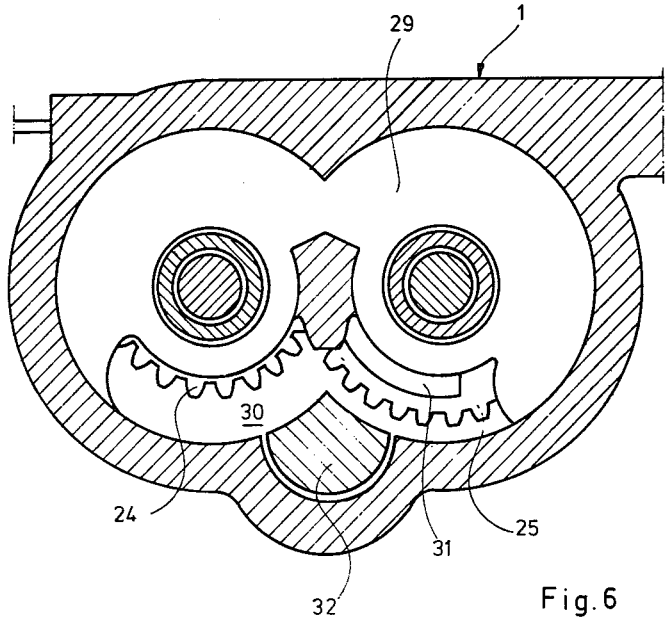
Figure 7:
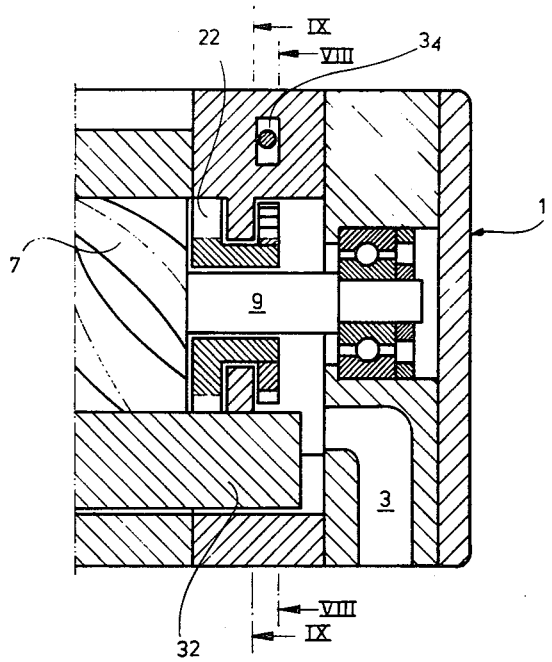
Figure 9:
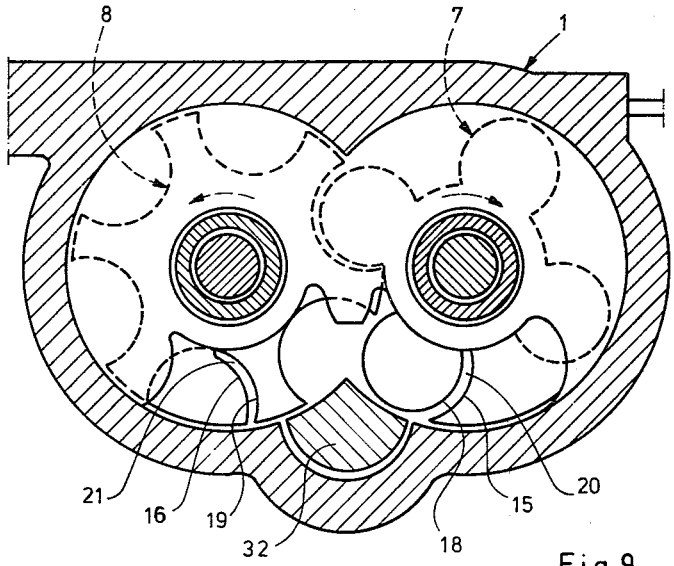
Figure 8:
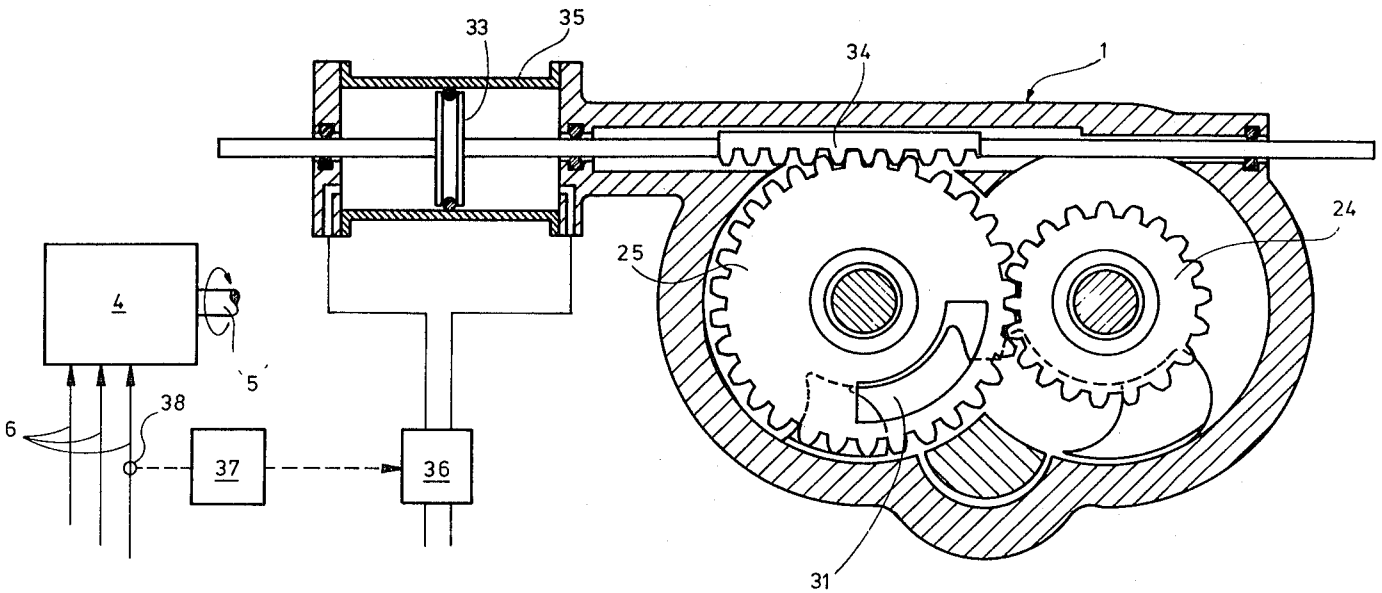

An embodiment of an apparatus according to the invention is shown in the attached drawings, in which FIG. 1 is a schematic view of the apparatus applied to a compressor which is driven by an electric motor; FIG. 2 is a longitudinal sectional view on line II—II in FIG. 4 through the outlet end of the compressor; FIG. 3 is a cross-sectional view on line III—III in FIG. 2 showing two rotatable discs which take a certain position; FIGS. 4 and 5 are cross-sectional views similar to FIG. 3 but showing the discs rotated to other positions; FIG. 6 is a sectional view on line VI—VI in FIG. 2 in a plane which lies behind the discs; FIG. 7 is a longitudinal sectional view on line VII—VII in FIG. 3 through the outlet end of the compressor; FIG. 8 is a cross-sectional view on line VIII—VIII in FIG. 7 with a motor to rotate the discs; and FIG. 9 is a cross-sectional view on line IX—IX in FIG. 7 showing the ends of two rotors of the compressor.

With reference to FIG. 1, a compressor 1 has an inlet 2 and an outlet 3. The compressor is driven by an electric motor 4 via a shaft 5. Cables 6 are provided for electric current for driving the motor 4.

The compressor has two rotors 7 and 8 (FIG. 2) from which stub shafts 9 and 10 protrude, which are journalled in bearings 11 and 12. Between the rotors and surrounding walls 13 working chambers 14 are formed for compressing the medium, which on rotation of the rotors is sucked from the inlet 2 into the working chambers at the inlet end (not shown) of the compressor.

On continued rotation of the rotors, the respective working chambers are closed towards the inlet and the medium is compressed until edges 15 and 16 (FIGS. 3 and 9) of an outlet port 17, together with edges 18 and 19 of the rotors, uncover passages 20 and 21 from the working chamber 14 to the outlet 3.

The edges 15 and 16 constitute edges on each of two discs 22 and 23, which are arranged rotatably around each one of the rotor shafts 9 and 10. By rotating the discs 22 and 23, the edges 15 and 16 can be adjusted so that the pressure in the working chamber, when it begins to open towards the outlet, becomes equal to the pressure in the outlet, whereby the energy which is consumed for compressing and transferring the medium from the inlet to the outlet becomes minimal.

The discs 22 and 23 are synchronized by gear wheels 24 and 25 in order that the passages 20 and 21 shall open simultaneously. The disc 22 with the gear wheel 24 is arranged in front of the rotor 7, which has four lands; and the disc 23 with the gear wheel 25 is arranged in front of the rotor 8, which has six lands. In order that the passages 20 and 21 shall open simultaneously, it is required that the number of gear teeth of the gear wheel 24 is to the number of gear teeth of the gear wheel 25 as 4:6.

In FIG. 4, the discs 22 and 23 are shown to be rotated so that the edges 15 and 16 take their one end position, at which other edges 26 and 27 of the discs abut against a stationary protrusion 28 having a surface which faces the rotors and is located in the same plane as the surfaces of the discs 22 and 23, which face the rotors (FIG. 2).

In FIG. 5, the discs 22 and 23 are shown to be rotated so that the edges 15 and 16 take their other end positions.

In FIG. 6, the outlet end wall 29 of the rotor chamber is shown with the discs 22 and 23 removed, the gear wheels 24 and 25 for synchronizing the discs 22 and 23 being visible through a stationary port 30, which connects the outlet port 17 with the outlet 3. The larger gear wheel 25 is provided with a recess 31 extending therethrough in order that the compressed medium can more easily pass the gear wheel 25. A slide valve 32 is usually provided in screw compressors and is movable in the longitudinal direction of the rotors for varying the capacity of the compressor. The slide valve 32 has nothing to do with the invention and is therefore not described in more detail.

The discs 22 and 23 are driven by a piston 33 (FIG. 8) via the gear wheels 24 and 25 and a rack 34. The piston 33, which is slidable in a cylinder 35, is driven by pressure fluid conducted to one side or the other of the piston 33 through a control valve 36. The latter is controlled by a regulator 37 which senses the amperage in a cable 6 by means of a sensing device 38. When the motor 4 works at constant voltage and constant number of revolutions per minute, this amperage is a measure of the energy which is required to compress a certain quantity of medium in the compressor.

With time intervals which preferably have equal length (e.g., every 30 seconds), the regulator starts a sensing sequence. At the beginning of the sequence, the regulator records the real energy need. Then the regulator gives a signal to the control valve 36 for rotating the discs 22 and 23 in an arbitrary direction. If the direction of rotation is wrong, the energy need of the motor 4 increases. The regulator 37 records this and reverses immediately the direction of rotation. When rotation takes place in the right direction the energy need decreases. When the energy need has reached its minimum and just begins to increase again, the sensing sequence is caused to cease.

At the end of the interval (after 30 seconds), a new sensing sequence starts. If one assumes that the arbitrary start impulse of the regulator to the control valve 36 directly gives the right direction of rotation for the discs, the energy need decreases. When the energy need has decreased to a minimum, the sensing sequence is again caused to cease.

The invention is also applicable, of course, when the compressor is driven by another type of motor than an electric one. If the compressor is driven by a Diesel engine at a constant number of revolutions per minute, the regulator 37 may be connected to the injection pump of the engine for sensing the fuel consumption, the regulator 37 serving to adjust the discs 22 and 23 so that the fuel consumption becomes minimal.

Within the scope of the invention, the regulator 37 can also be arranged so that it senses the torque in the shaft 5, which is assumed to rotate at a constant number of revolutions per minute, the regulator 37 serving to adjust the discs 22 and 23 so that the torque becomes minimal.

The invention is not limited to compressors where the adjustable edge of the outlet port is arranged on a disc which is rotatable in the end plane of the rotor housing. Within the scope of the invention, said edge can also be arranged on an element located in the barrel wall of the rotor chamber and is displaceable in a direction parallel to the longitudinal direction of the rotors.

I claim:

1. In the operation of a rotary compressor where a medium is compressed in a working chamber formed between at least one rotor and a wall surrounding the rotor, said working chamber on rotation of the rotor sucking in the medium from an inlet, after which the working chamber is closed from the inlet and decreased in volume so as to compress the medium, the working chamber thereafter being brought into communication with an outlet by an edge of the rotor together with an adjustable edge of an outlet port uncovering a passage from the working chamber to the outlet, said edge of the outlet port being displaceable to vary the built-in volume ratio of the compressor and cause the pressure in the working chamber, when it begins to open towards the outlet, to become adapted to the pressure in the outlet, the method which comprises sensing an operational quantity which is a measure of the energy supplied to the rotor for comprising the medium and transferring it to the outlet, and intermittently displacing said edge of the outlet port until said operational quantity acquires a value corresponding to a minimum of said energy.

2. The method of claim 1, in which the rotor is driven by an electric motor, said operational quantity being the amperage supplied to the electric motor.

3. The method of claim 1, in which said displacing of said edge is effected at predetermined time intervals during continuous operation of the compressor.

4. In a rotary compressor, the combination of a rotor, a housing having a wall surrounding the rotor and forming therewith a working chamber, the housing having an inlet for a medium to be compressed and an outlet for the compressed medium, the rotor being operable by rotation thereof to cause the working chamber to suck in the medium from said inlet and thereafter to close the chamber from the inlet and decrease the volume of the chamber, thereby compressing the medium therein, the housing having a passage from the working chamber to said outlet and also having a port with an adjustable edge for uncovering said passage, the rotor being operable after said compressing of the medium to bring the working chamber into communication with the outlet by an edge of the rotor together with said adjustable edge uncovering said passage, said adjustable edge of the port being displaceable to vary the built-in volume ratio of the compressor and cause the pressure in the working chamber, when it begins to communicate with the outlet, to become adapted to the pressure in the outlet, means for supplying energy to the rotor for compressing the medium and transferring it to said outlet, means for sensing an operational quantity which is a measure of said supplied energy, an adjusting motor operatively connected to said adjustable edge of said port, and a regulator connected to the sensing means for operating the motor intermittently to displace said edge of the outlet port until said operational quantity acquires a value corresponding to a minimum of said energy.

5. The combination of claim 4, in which the regulator is operable to operate the motor with equal time intervals.

6. The combination of claim 4, in which said energy supplying means include an electric motor for driving the rotor and operable at constant voltage and at a constant number of revolutions per minute, the sensing means being operable to sense the amperage supplied to the electric motor, said amperage constituting said operational quantity.

7. The compressor of claim 4, in which said regulator is operable to effect said operation of the motor at predetermined time intervals during continuous operation of the compressor.

* * * * *